US005915921A

United States Patent [19]

Sabini

[11] Patent Number: 5,915,921

[45] Date of Patent: Jun. 29, 1999

[54] WEARING RING FOR VOLUTE PUMP

[75] Inventor: Eugene P. Sabini, Skaneateles, N.Y.

[73] Assignee: Goulds Pumps, Incorporated, Seneca Falls, N.Y.

[21] Appl. No.: 08/939,434

[22] Filed: Sep. 26, 1997

[51] Int. Cl.[6] ..... F01D 11/08

[52] U.S. Cl. ..... 415/173.1; 415/170.1; 415/174.4; 415/208.1; 415/173.6

[58] Field of Search ..... 415/170.1, 172.1, 415/173.1, 173.4, 173.6, 174.4, 211.1, 208.1; 277/407, 609, 630

[56] References Cited

U.S. PATENT DOCUMENTS 794,185 7/1905 Meden ..... 415/172.1
4,037,985 7/1977 Karassik et al. ..... 415/172.1
4,927,327 5/1990 Keller ..... 415/172.1

FOREIGN PATENT DOCUMENTS 3700213 7/1987 Germany ..... 415/173.1

*Primary Examiner*—Thomas E. Denion
*Assistant Examiner*—Richard Woo
*Attorney, Agent, or Firm*—Brezina & Ehrlich

[57] ABSTRACT

A volute pump having a suction volute, a discharge volute and an impeller. The volute pump further comprises a wearing ring seated between the interior walls of the suction volute and the impeller. The wearing ring has an accurate extended portion which extends into the passage of the suction volute to prevent flow separation caused by dead zones in the suction passage.

3 Claims, 3 Drawing Sheets

WEARING RING FOR VOLUTE PUMP

BACKGROUND OF INVENTION

The present invention relates to a volute, double suction pump, and more particularly to the design of the wearing ring of the pump.

Volute pumps are frequently used to pump abrasive liquids found in industrial, municipal and marine industry services. Volute pumps are particularly well-suited to service these industries because the volute shape of the pump allows it to operate at capacities above or below design capacity or at interrupted high head.

Volute pumps are designed with two separate sections: the inlet volute and the discharge volute. These two volutes are joined together at the impeller through the use of a wearing ring. Typically, the wearing ring acts to guide the flow of fluid into the impeller eye and decrease the recirculation of fluid through the pump. Wearing rings also act to maintain proper impeller hub clearance, maintain pump performance, protect the pump casing and impeller from excess wear and increase pump efficiency.

Often, the inlet volute of the pump is designed so that a portion of the volute wall follows the contour of the discharge volute. In this type of design, a valley is formed in the inlet volute (See FIGS. 2, 3 and 5). Analysis of the fluid flow through these type of pumps indicates that the valley creates a dead zone in the flow of fluid as it passes over this region. This dead zone creates a separation in the flow of fluid and thus produces non-uniform flow into the eye of the impeller, causes excessive operational noise, and inhibits the pump's efficiency.

In the efficient design of double suction pumps, it is necessary to fill in the suction passage, or alternatively, a portion of the suction passage has to wrap around the discharge volute. In the past, this was not deemed cost effective or necessary, as extra coring in the molding process at the foundry would be necessary.

It has recently been determined, however, that efficient pump design dictates that the valley formed in the suction passage wall be filled, since as fluid flows passes the valley flow separation occurs causing eddies or secondary flow. This results in the development of low pressure areas, creating unwanted noise and loss of efficiency. In pumps designed in accordance with the present invention, suction flow into the eye of the impeller is improved due to the prevention of flow separation.

SUMMARY OF INVENTION

Accordingly, it is the object of the present invention to eliminate the dead zone created in the inlet volute by providing a wearing ring configured to fill the dead zone created by the valley. By eliminating the flow separation, the wearing ring reduces the noise of the pump, creates a more uniform flow of entry into the impeller and provides a cost effective solution to the flow separation problem occurring in the inlet volute of the pumps.

The present invention comprises a volute pump having a suction volute, a discharge volute and an impeller. The volute pump further comprises a wearing ring seated between the interior walls of the suction volute and the impeller. The wearing ring has an accurate extended portion which extends into the passage of the suction volute above the dead zone to prevent flow separation caused by dead zones in the suction passage.

DESCRIPTION OF PREFERRED EMBODIMENT

Figure 1:
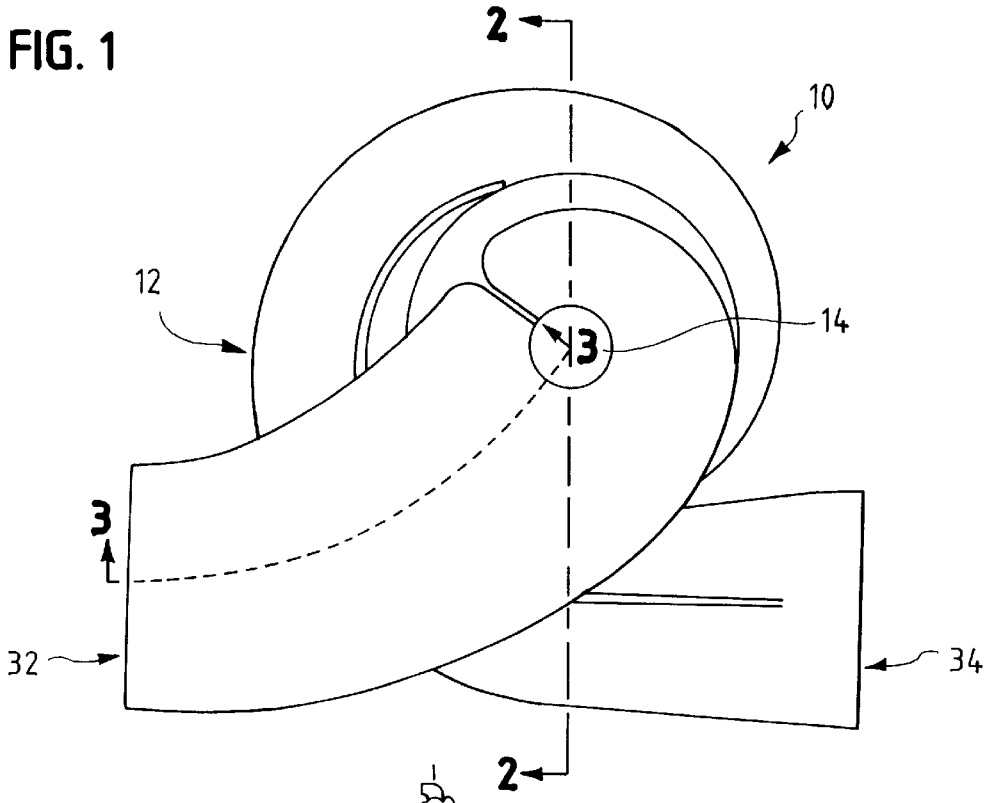
FIG. 1 is a side elevation view of the exterior of a standard volute pump.
Figure 2:
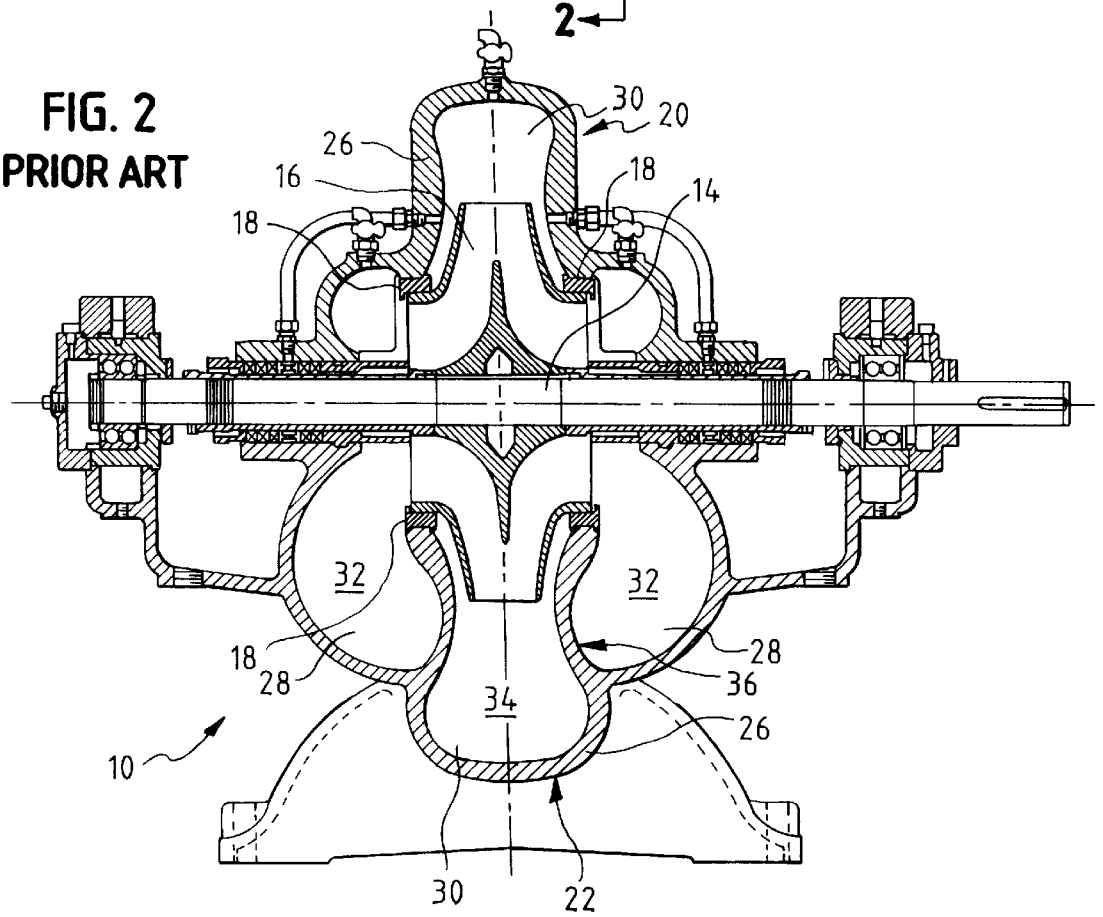
FIG. 2 PRIOR ART
FIG. 2 is a cross-section of a standard volute pump taken along line B—B of FIG. 1.
Figure 3:
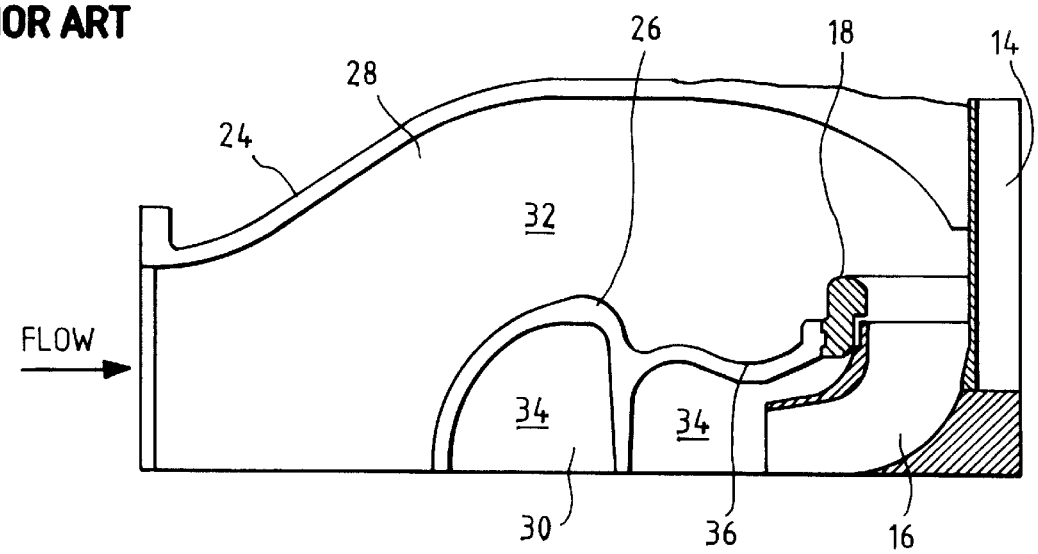
FIG. 3 PRIOR ART
FIG. 3 is a cross-section of a standard double volute pump using a prior art wearing ring, the cross-section taken along line A—A of FIG. 1.
Figure 4:
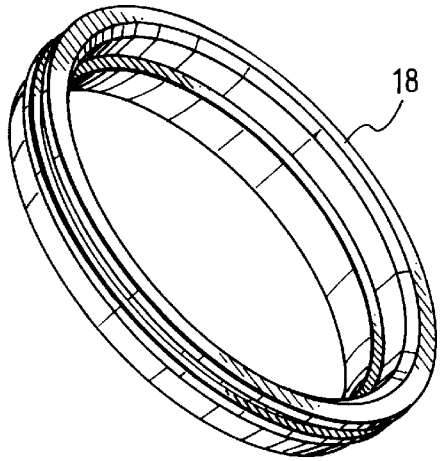
FIG. 4 PRIOR ART
FIG. 4 is a perspective view of the prior art wearing ring.

As seen in FIGS. 1–3 and 5, the volute pump 10 is comprised generally of a casing 12, a shaft 14, an impeller 16 and wearing rings 18. As illustrated in FIG. 2, the casing 12 of the pump 10 is divided into two halves, an upper half 20 and lower half 22, which are bolted and doweled together to form the pump casing 12. Both the upper half 20 and lower half 22 of the casing 12 have interior walls 24 and exterior walls 26 which define the suction volute 28 (i.e. inlet volute) and the discharge volute 30 (i.e. outlet volute) of the pump 10. The suction volute 28 serves as the inlet passage 32 for fluid flow and the discharge volute 30 serves as the outlet passage 34 for fluid flow.

As illustrated in FIG. 2, the shaft 14 and impeller 16 are interposed between and supported by the two halves 20 and 22 of the casing 12. The wearing rings 18 are positioned between the impeller 16 and the interior walls 24 of the upper and lower halves 20 and 22 of the casing 12. The wearing rings 18 are typically held against the interior walls 24 in the lower half 20 of the casing 12 by a double tongue and groove lock and held against the interior walls 24 of the upper half 22 of the casing 12 by a single tongue and groove lock.

In operation, fluid is suctioned into the suction volute 12 by the rotating impeller 16. The fluid is then guided into the inlet of the impeller 16 by the wearing rings 18 and then forced out of the pump through the discharge volute 30.

Because the interior walls 24 of the casing 12 generally divide the suction volute 28 from the discharge volute 30, a portion of the suction volute 28 walls may be designed to follow the contour of the discharge volute 30. (See FIGS. 2, 3 and 5). When the interior walls 24 of the suction volute 28 follow the contour of the discharge volute 30 or outlet passage 34, valleys 36 are formed in the inlet passages 32. As discussed above, analysis of the fluid flow through inlet passages 34 having valleys 36 demonstrates that "dead zones" are formed in these valleys 36. The dead zones cause fluid flow separation, which creates noise, non-uniform fluid flow into the impeller, and decreased pump efficiency.

Figure 5:
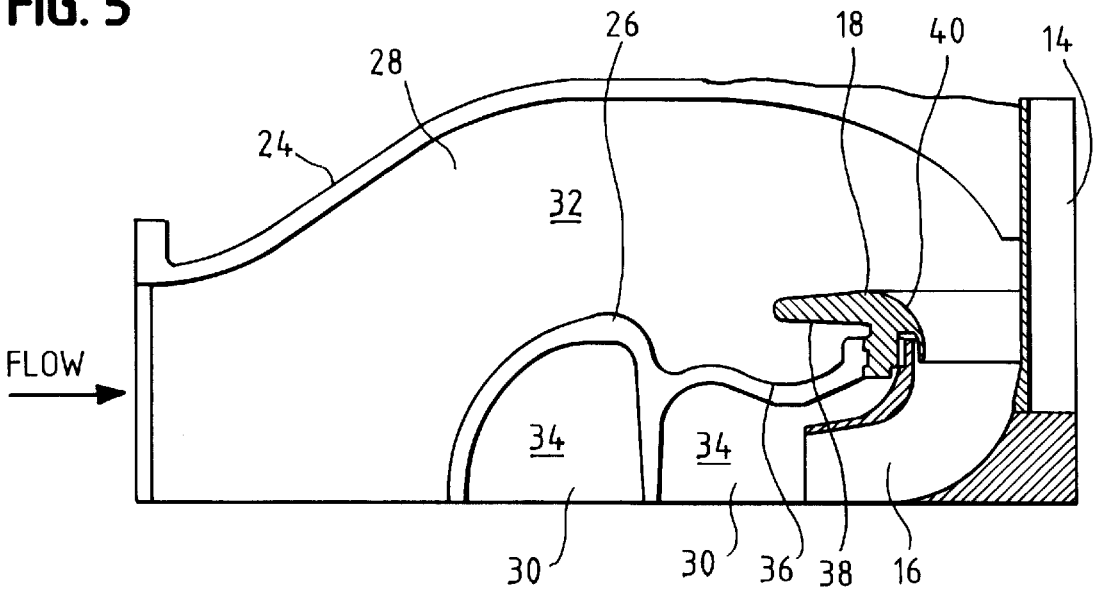
FIG. 5 is a cross-section of a standard double volute pump using the wearing ring of the present invention, the cross-section taken along line A—A of FIG. 1.
Figure 6:
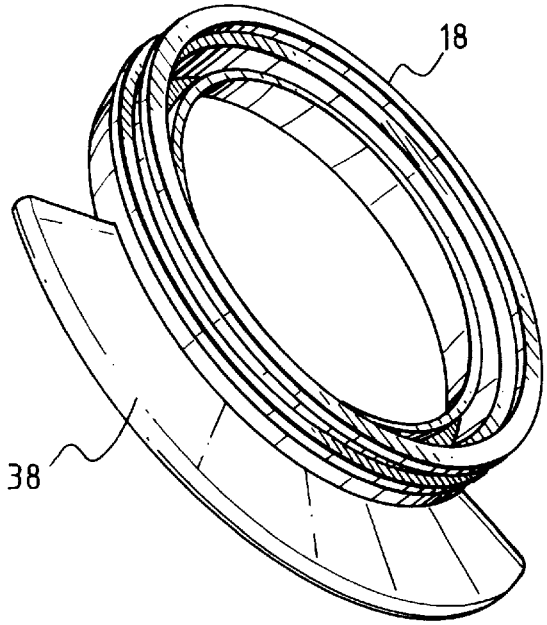
FIG. 6 is a perspective view of the wearing ring of the present invention.

As seen in FIGS. 5 and 6, the wearing ring 18 of the present invention comprises an extended portion 38. The extended portion 38 of the wearing ring 18 acts to fill the "dead zone" created by the valleys 36 and control the flow of fluid over the valleys 36 so that the fluid flow no longer separates. Eliminating the flow separation creates uniform flow into the impeller, quiets the pump and increases the pump efficiency.

As illustrated by FIGS. 5 and 6, the extended portion 38 of the wearing ring 18 does not completely circumscribe the body of the wearing ring 18 but is only of a length and width sufficient to extend over the valley 36 and prevent the separation of the fluid flow through the inlet passage 32. FIG. 5 shows that both the shape of the extended portion 38 and the interior portion 40 of the wearing ring 18 are slightly curved to direct the fluid flow into the eye of the impeller 16. This curved shape is consistent with the purpose of the wearing ring 18 and helps maintain a uniform flow into the impeller 16.

Although the foregoing detailed description of the present invention has been described by reference to a single exemplary embodiment, and the best mode contemplated for carrying out the present invention has been herein shown and described, it will be understood that modifications or variations in the structure and arrangement of this embodiment other than those specifically set forth herein may be achieved by those skilled in the art and that such modifications are to be considered as being within the overall scope of the present invention. Therefore, it is contemplated to cover the present invention and any and all modifications, variations, or equivalents that fall within the true spirit and scope of the underlying principles disclosed and claimed herein. Consequently, the scope of the present invention is intended to be limited only by the attached claims.

I claim:

1. A pump for pumping fluid having a suction volute, a discharge volute and an impeller, the impeller being interposed between the suction volute and the discharge volute so that the impeller suctions the fluid flow through the suction volute and forces the flow of fluid out of the discharge volute of the pump, both the suction volute and discharge volute having walls which form a suction passage and a discharge passage respectively, the walls of the suction volute being partially contoured to correspond with the walls of the discharge volute such that the walls of the suction volute create a valley in the suction passage, comprising:

(a) a wearing ring positioned between the walls of the suction volute and the impeller of the pump, said wearing ring having an extended portion extending outward into the suction volute and over the valley formed in the walls of the suction passage.

2. A pump as recited in claim 1, wherein said extended portion of said wearing ring has a length and width sufficient to extend over the valley formed in the walls of the suction passage and prevent the separation of flow over the valley in the suction passage.

3. A pump for pumping fluid having a suction volute, a discharge volute, and an impeller, the suction volute and discharge volute each being formed by a curved casing, the casing having interior and exterior walls, the impeller being positioned in the discharge volute of the pump to suction the flow of fluid through the suction volute of the pump and force the flow of fluid out of the discharge volute of the pump, the pump further comprising:

(a) a wearing ring, said wearing ring positioned between the interior walls of the casing and the impeller, (b) said wearing ring having an extended portion which extends into the suction volute of the chamber to eliminate fluid flow separation within the suction volute.

* * * * *